United States Patent [19]

Joyner et al.

[11] Patent Number: 4,865,207

[45] Date of Patent: Sep. 12, 1989

[54] NURSING BOTTLE WITH MICROPOROUS MEMBRANE

[76] Inventors: Jack S. Joyner, 10317 Cliota St., Whittier, Calif. 90601; Ernie Maushund, 15262 El Soneto Dr., Whittier, Calif. 90605

[21] Appl. No.: 204,544

[22] Filed: Jun. 9, 1988

[51] Int. Cl.[4] ..... A61J 9/00; A61J 9/04

[52] U.S. Cl. ..... 215/11.5; 215/11.1

[58] Field of Search ..... 215/11.1–11.6; 122/DIG. 15; 428/422; 137/526, 907; 251/335.2, 362

[56] References Cited

U.S. PATENT DOCUMENTS

| | | | |
|---|---|---|---|
| 921,387 | 5/1909 | Etter | 215/11.5 |
| 1,972,895 | 9/1934 | MacCoy | 215/11.5 |
| 2,094,721 | 10/1937 | Puetz | 215/11.5 |
| 2,394,722 | 2/1946 | Sloane | 215/11.5 |
| 2,907,485 | 10/1959 | Lunden | 215/11.1 |
| 3,134,495 | 5/1964 | Carbonel | 215/11.5 |
| 3,200,980 | 8/1965 | Jamell | 215/11.5 |
| 3,292,808 | 12/1966 | Greene | 215/11.5 |
| 3,525,745 | 10/1950 | Wycoff | 215/11.5 |
| 3,768,683 | 10/1973 | Van Den Bosch | 215/11.5 |
| 3,962,153 | 6/1976 | Gore | 428/422 X |
| 4,010,861 | 3/1977 | Welten | 215/11.5 |
| 4,168,298 | 9/1979 | Fitzgerald | 428/222 X |
| 4,401,224 | 8/1983 | Alonso | 215/11.5 |
| 4,545,491 | 10/1985 | Bisgaard et al. | 215/11.5 |
| 4,685,577 | 8/1987 | Chen | 215/11.5 |
| 4,723,668 | 2/1988 | Cheng | 215/11.5 |

FOREIGN PATENT DOCUMENTS

| | | | |
|---|---|---|---|
| 971323 | 7/1975 | Canada | 428/422 |
| 434459 | 2/1912 | France | 215/11.5 |

OTHER PUBLICATIONS

'RCA uses "Teflon" TFE to make Black Boxes Breath', the Journal of Teflon, vol. 4, No. 1, 1963, p. 8.

"Expanded PTFE: It's A Whole New Ball Game", reprinted from Plastics World, July 1971.

*Primary Examiner*—Sue A. Weaver

*Attorney, Agent, or Firm*—Edgar W. Averill, Jr.

[57] ABSTRACT

An improved nursing bottle for infants. The nursing bottle has a microporous membrane portion which allows air to enter the nursing bottle thereby preventing a partial vacuum within the bottle.

11 Claims, 1 Drawing Sheet

NURSING BOTTLE WITH MICROPOROUS MEMBRANE

BACKGROUND OF THE INVENTION

The field of the invention is nursing bottles and the invention relates more particularly to nursing bottles which prevent the buildup of a negative pressure within the bottle.

Many attempts have been made to provide a nursing bottle which has some means for air to enter the interior of the bottle as it is being used. Various constructions are shown in the various U.S. Pat. Nos. 1,972,895; 2,094,721; 2,394,722; 3,200,980; 3,292,808; 3,768,683; 4,010,861; 4,401,224; 4,545,491; 4,685,577; 4,723,668; and French Pat. No. 1,058,610. Two major shortcomings occur with the constructions shown in the above-listed patents. First is the difficulty of cleaning the device in that the devices invariably have small orifices or cracks which can trap milk and which, if not carefully cleaned, can result in pockets of bacteria. Secondly, the constructions are inherently expensive.

The large number of attempts to solve this problem shows a recognition of the problem caused by a negative pressure within the bottle which leads to bubbles and discomfort for the baby. Also, the device should facilitate the cleaning of the bottle rather than providing a source of bacterial contamination.

SUMMARY OF THE INVENTION

It is an object of the present invention to provide a device for preventing negative pressure within a nursing bottle, which device also facilitates the cleaning of the bottle.

The present invention is for an improved nursing bottle for infants of the type having an elongated, generally rigid body having a nipple held at the top thereof. The improvement comprises an air vent held at the bottom, said air vent comprising a microporous membrane. Preferably, the microporous membrane is a teflon-based membrane having more than one billion pores per square inch. Such membrane permits the passage of air therethrough, but does not permit liquids to flow therethrough under normal pressures. Preferably, the microporous membrane is disk shaped and has a gasket material molded around the periphery thereof. A protective screen may be held against the lower surface or against both the lower and inner surfaces. Once the microporous membrane is removed, the bottle is particularly easy to clean.

DESCRIPTION OF THE PREFERRED EMBODIMENTS

Figure 1:
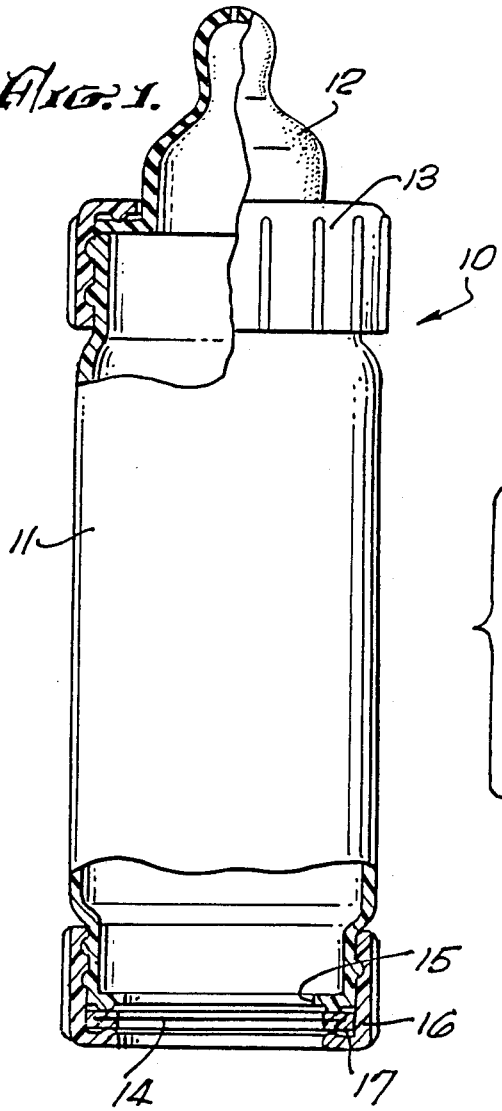
FIG. 1 is a side view, partly in cross-section, of the improved nursing bottle of the present invention.

The improved nursing bottle of the present invention is shown in FIG. 1 and indicated generally by reference character 10. Bottle 10 has a generally cylindrical body 11 which is injection molded or blow molded from a polymeric material which can be readily sterilized. The body 11 is made from a conventional material. Nipple

12 is also conventional and held on the top of the bottle by conventional threaded ring 13. A microporous membrane 14 is held over an open bottom 15 by a threaded ring 16. It can easily be seen that when threaded ring 16 and microporous membrane 14 are removed from the open bottom 15, that the generally cylindrical body can be easily cleaned by a bottle brush and by boiling or by other conventional sterilization techniques.

Microporous membrane 14 is fabricated from a material having a large number of pores. One example of such material is sold under the trademark "GORE-TEX" and is said to have nine billion pores per square inch. The size of these pores is many times larger than a water molecule and yet readily lets air therethrough. Thus, the microporous membrane 14 prevents any negative pressure within nursing bottle 10 during use, while at the same time is easily removable. Furthermore, the microporous membrane may be sterilized by boiling or other sterilization techniques and reused. The fabric, being fabricated from a teflon-based membrane, is non-toxic and odor free and is also strong so that it will not easily tear.

Figure 2:
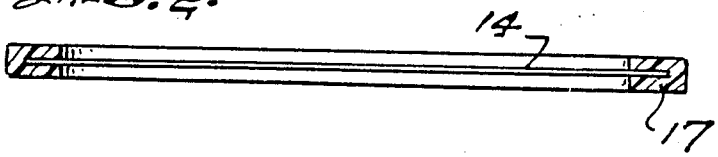
FIG. 2 is an enlarged cross-sectional view of the microporous membrane of the nursing bottle of FIG. 1.

The bottle 10 shows simply a microporous membrane disk held by threaded ring 16 against the open bottom 15 of bottle 10. FIG. 2 shows a microporous membrane having an elastomeric ring molded around the periphery thereof. This helps prevent the leakage around the edge of the microporous membrane disk 14. The elastomeric ring is indicated by reference character 17.

Figure 3:
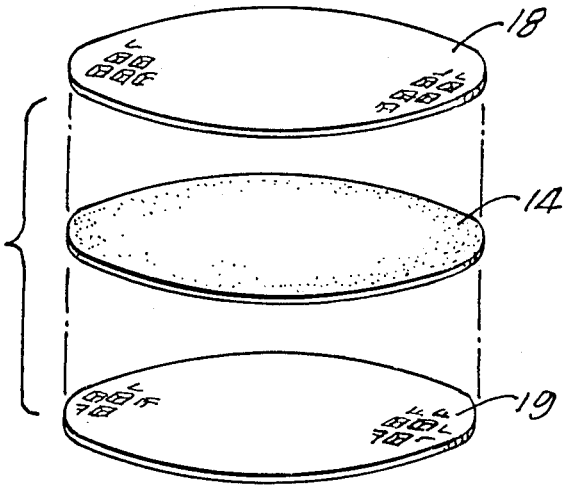
FIG. 3 is an exploded, perspective view of the microporous membrane with both an upper and lower protective screen.

A pair of protective plastic grids 18 and 19 are shown in exploded, perspective view in FIG. 3. These could be injection molded or woven disks and should be capable of being sterilized. These grids could be placed on only one side of membrane 14 or on both sides as shown in FIG. 3. The grids would add physical strength to the membrane and prevent the membrane from being broken by being hit against a sharp object.

The membrane should be fabricated from a material which has sufficient physical strength to withstand the abuse of nursing bottles as being hit against various toys and other objects. It should have more than one billion pores per square inch and is preferably a woven membrane. Although a standard type of cylindrical nursing bottle is shown in FIG. 1, the microporous membrane of the present invention could be used on nursing bottles of other shapes.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. An improved nursing bottle for infants of the type having an elongated, generally rigid body having a nipple held at the top thereof, wherein the improvement comprises:

an air vent held at the bottom thereof, said air vent comprising a microporous membrane and said nursing bottle having no internal piston.

2. The improved baby bottle of claim 1 wherein said microporous membrane is a teflon based membrane.

3. The improved baby bottle of claim 2 wherein said microporous membrane is a woven membrane and said woven membrane has more than one billion pores per square inch.

4. The improved baby bottle of claim 1 wherein said microporous membrane is circular and has an elastic gasket bond around the periphery thereof.

5. The improved baby bottle of claim 4 further including a protective screen adjacent the outer surface of the microporous membrane.

6. The improved baby bottle of claim 5 further including a protective screen adjacent the inner surface of the microporous membrane.

7. An improved nursing bottle for infants of the type having an elongated, generally rigid body having a nipple at the top thereof, wherein the improvement comprises:

an air vent held at the bottom thereof, said air vent comprising a microporous membrane disk extending about to the outer edges of the nursing bottle and said nursing bottle having no internal piston.

8. The improved nursing bottle of claim 7 wherein said microporous membrane is removable to facilitate the cleaning of the bottle.

9. The improved nursing bottle of claim 8 wherein said microporous membrane has an elastomeric gasket molded around the periphery thereof.

10. The improved nursing bottle of claim 9 further including a protective screen held adjacent the outer surface of the microporous membrane.

11. The improved nursing bottle of claim 10 further including a protective screen held against the inner surface of said microporous membrane.

* * * * *